US011148909B2

(12) United States Patent
Doi

(10) Patent No.: US 11,148,909 B2
(45) Date of Patent: Oct. 19, 2021

(54) PASSENGER-CONVEYOR STEP-CHAIN MONITORING SYSTEM

(71) Applicant: Mitsubishi Electric Corporation, Tokyo (JP)

(72) Inventor: Shingo Doi, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 108 days.

(21) Appl. No.: 16/476,553

(22) PCT Filed: Jun. 14, 2017

(86) PCT No.: PCT/JP2017/021977
§ 371 (c)(1),
(2) Date: Jul. 9, 2019

(87) PCT Pub. No.: WO2018/229901
PCT Pub. Date: Dec. 20, 2018

(65) Prior Publication Data

US 2020/0095098 A1 Mar. 26, 2020

(51) Int. Cl.
*B66B 25/00* (2006.01)
*B66B 29/00* (2006.01)
*B66B 31/00* (2006.01)

(52) U.S. Cl.
CPC ..... *B66B 25/006* (2013.01); *B66B 29/00* (2013.01); *B66B 31/00* (2013.01)

(58) Field of Classification Search
CPC ..... B66B 25/006; B66B 29/00; B66B 31/00
USPC ..... 198/322, 323
See application file for complete search history.

(56) References Cited

U.S. PATENT DOCUMENTS 5,708,416 A * 1/1998 Zaharia ..... B66B 27/00 198/323
5,785,165 A * 7/1998 Stahlhut ..... B66B 25/00 198/322
2012/0043180 A1* 2/2012 Braasch ..... B66B 25/006 198/322

(Continued)

FOREIGN PATENT DOCUMENTS

CN 101353132 A 1/2009
JP 11-325829 A 11/1999

(Continued)

OTHER PUBLICATIONS

International Search Report and Written Opinion dated Aug. 8, 2017 for PCT/JP2017/021977 filed on Jun. 14, 2017, 9 pages including English Translation of the International Search Report.

(Continued)

*Primary Examiner* — James R Bidwell
(74) *Attorney, Agent, or Firm* — Xsensus LLP

(57) ABSTRACT

Provided is a passenger-conveyor step-chain monitoring system capable of monitoring elongation of a step chain without adding a special device. The passenger-conveyor step-chain monitoring system includes a monitoring unit configured to monitor elongation of a step chain attached to a step of a passenger conveyor based on a result of detecting the step by a sensor provided to detect an absence of the step. With this configuration, it is possible to monitor elongation of the step chain without adding a special device.

2 Claims, 5 Drawing Sheets

(56) References Cited

U.S. PATENT DOCUMENTS

2012/0283870 A1* 11/2012 Senger ..... B66B 25/006
700/230

FOREIGN PATENT DOCUMENTS

| | | | |
|---|---|---|---|
| JP | 2000-291748 | A | 10/2000 |
| JP | 2002-241072 | A | 8/2002 |
| JP | 2009-029524 | A | 2/2009 |
| JP | 2009-51636 | A | 3/2009 |
| JP | 2013-159466 | A | 8/2013 |
| JP | 2015-227242 | A | 12/2015 |

OTHER PUBLICATIONS

Notification of Reasons for Refusal received for Japanese Patent Application No. 2018-523839, dated Jun. 5, 2018, 9 pages including English Translation.

Notification of Reasons for Refusal received for Japanese Patent Application No. 2018-523839, dated Aug. 14, 2018, 9 pages including English Translation.

Notification of Reasons for Refusal received for Japanese Patent Application No. 2018-523839, dated Dec. 4, 2018, 9 pages including English Translation.

Office Action dated May 27, 2020 in Chinese Patent Application No. 201780090878.0, 10 pages.

* cited by examiner

PASSENGER-CONVEYOR STEP-CHAIN MONITORING SYSTEM

CROSS-REFERENCE TO RELATED APPLICATION

The present application is based on PCT filing PCT/JP2017/021977, filed Jun. 14, 2017, the entire contents of which are incorporated herein by reference.

FIELD

The present invention relates to a passenger-conveyor step-chain monitoring system.

BACKGROUND

For example, PTL 1 discloses a passenger-conveyor step-chain monitoring system. According to the monitoring system, it is possible to monitor elongation of a step chain.

CITATION LIST

Patent Literature

[PTL 1] JP 2002-241072 A

SUMMARY

Technical Problem

However, in the monitoring system described in PTL 1, it is necessary to newly provide an additional sensor. Accordingly, a cost for monitoring elongation of a step chain is increased.

The present invention has been made to solve the above-described problem. An object of the present invention is to provide a passenger-conveyor step-chain monitoring system capable of monitoring elongation of a step chain without adding a special device.

Solution to Problem

A passenger-conveyor step-chain monitoring system according to the present invention includes a monitoring unit configured to monitor elongation of a step chain attached to a step of a passenger conveyor based on a result of detecting the step by a sensor provided to detect an absence of the step.

Advantageous Effects of Invention

According to the present invention, elongation of a step chain is monitored based on a result of detecting a step by a sensor provided to detect an absence of a passenger-conveyor step. Accordingly, it is possible to monitor elongation of a step chain without adding a special device.

DESCRIPTION OF EMBODIMENTS

Figure 1:
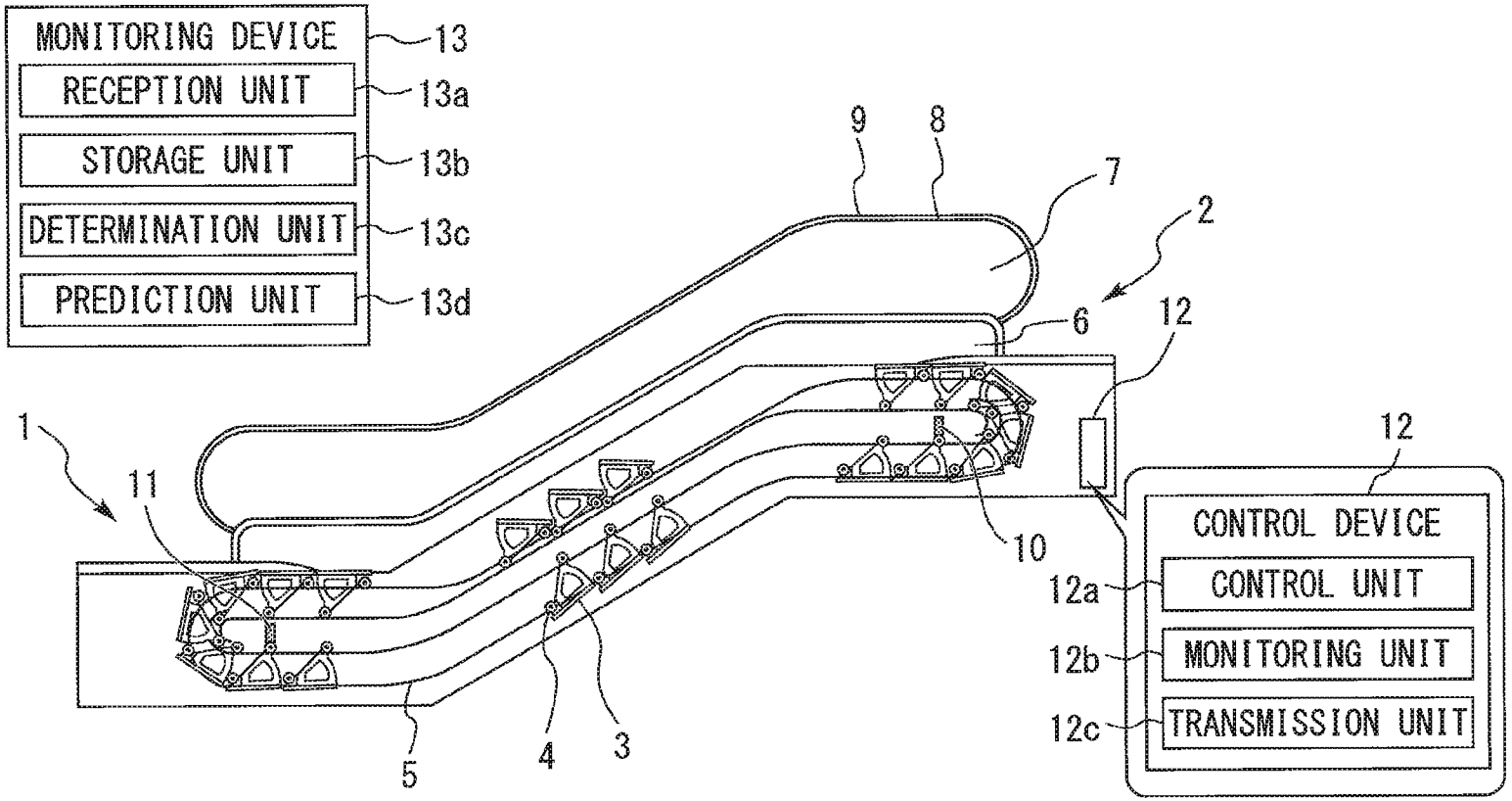
FIG. 1 is a structural diagram of a passenger conveyor to which a passenger-conveyor step-chain monitoring system according to Embodiment 1 of the present invention is applied.

Modes for carrying out the present invention will be described with reference to the accompanying drawings. Note that in the drawings, the same or corresponding parts are denoted by the same reference numerals. Redundant descriptions of the parts are simplified or omitted as needed.

Embodiment 1

FIG. 1 is a structural diagram of a passenger conveyor to which a passenger-conveyor step-chain monitoring system according to Embodiment 1 of the present invention is applied.

The passenger conveyor illustrated in FIG. 1 is an escalator. For example, the passenger conveyor is movable between adjacent floors. A lower platform 1 is provided on a lower one of the adjacent floors. An upper platform 2 is provided on an upper one of the adjacent floors.

A plurality of steps 3 is provided between the lower platform 1 and the upper platform 2. The plurality of steps 3 is formed in an endless shape.

A pair of drive rollers 4 is provided to each of the plurality of steps 3. One of the pair of drive rollers 4 is provided on one side of the corresponding step 3. One of the pair of drive rollers 4 is provided on a leading end portion of a tread of the corresponding step 3. The other one of the pair of drive rollers 4 is provided on the other side of the corresponding step 3. The other one of the pair of drive rollers 4 is provided on a leading end portion of a tread of the corresponding step 3.

One of a pair of step chains 5 is provided on one side of the passenger conveyor. One of the pair of step chains 5 is formed in an endless shape. One of the pair of step chains 5 is attached to the vicinity of one of the pair of drive rollers 4 in the plurality of steps 3. The other one of the pair of step chains 5 is provided on the other side of the passenger conveyor. The other one of the pair of step chains 5 is formed in an endless shape. The other one of the pair of step chains 5 is attached to the vicinity of the other one of the pair of drive rollers 4 in the plurality of steps 3.

One of a pair of skirt guards 6 is adjacent to one side of the plurality of steps 3. The other one of the pair of skirt guards 6 is adjacent to the other side of the plurality of steps 3. One of a pair of parapets 7 is fixed to an upper portion of one of the pair of skirt guards 6. The other one of the pair of parapets 7 is fixed to an upper portion of the other one of the pair of skirt guards 6.

One of a pair of guide rails 8 is provided at an upper portion of one of the pair of parapets 7. The other one of the pair of guide rails 8 is provided at an upper portion of the other one of the pair of parapets 7. One of a pair of moving hand rails 9 is formed in an endless shape. One of the pair of moving hand rails 9 is guided to one of the pair of guide rails 8. The other one of the pair of moving hand rails 9 is formed in an endless shape. The other one of the pair of moving hand rails 9 is guided to the other one of the pair of guide rails 8.

An upper sensor 10 is provided at an upper portion of the passenger conveyor. For example, the upper sensor 10 is provided immediately above each of the return-path-side steps 3. The upper sensor 10 is provided to detect an absence of each step 3. A lower sensor 11 is provided at a lower portion of the passenger conveyor. For example, the lower sensor 11 is provided immediately above each of the return-path-side steps 3. The lower sensor 11 is provided to detect an absence of each step 3.

A control device 12 is provided at an upper portion of the passenger conveyor. The control device 12 includes a control unit 12*a*, a monitoring unit 12*b*, and a transmission unit 12*c*.

A monitoring device 13 is provided at a position away from the passenger conveyor. For example, the monitoring device 13 is provided in a control room of the building. For example, the monitoring device 13 is provided in a maintenance company for the passenger conveyor. The monitoring device 13 includes a reception unit 13*a*, a storage: b, a determination unit 13*c*, and a prediction unit 13*d*.

In the control device 12, the control unit 12*a* drives the step chains 5 to cause the plurality of steps 3 to move in a circulating manner. The monitoring unit 12*b* monitors elongation of the pair of step chains 5 based on the results of detecting the steps 3 by the upper sensor 10 and the lower sensor 11. The transmission unit 12*c* transmits information about the monitoring result from the monitoring unit 12*b* to an external device at a preliminarily set timing. For example, the information about the monitoring result from the monitoring unit 12*b* is constantly transmitted. For example, the information about the monitoring result from the monitoring unit 12*b* is periodically transmitted.

In the monitoring device 13, the reception unit 13*a* receives the information from the transmission unit 12*c* of the control device 12. The storage unit 13*b* stores the information received by the reception unit 13*a*. Based on the information received by the reception unit 13*a*, the determination unit 13*c* determines whether the current time corresponds to a replacement period for replacing the step chains 5. The prediction unit 13*d* predicts the replacement period for replacing the step chains 5 based on the history of the information received by the reception unit 13*a*.

Thus, each of the control device 12 and the monitoring device 13 functions as a monitoring system.

Next, a method for monitoring elongation of the step chains 5 and a method for determining the replacement period for replacing the step chains 5 will be described with reference to FIGS. 2 and 3.

Figure 2:
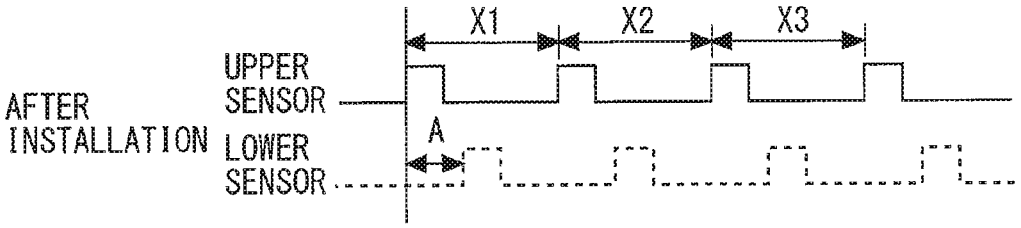
FIG. 2 is a graph illustrating a detection result from an upper sensor and a detection result from a lower sensor in the passenger-conveyor step-chain monitoring system according to Embodiment 1 of the present invention.
Figure 3:
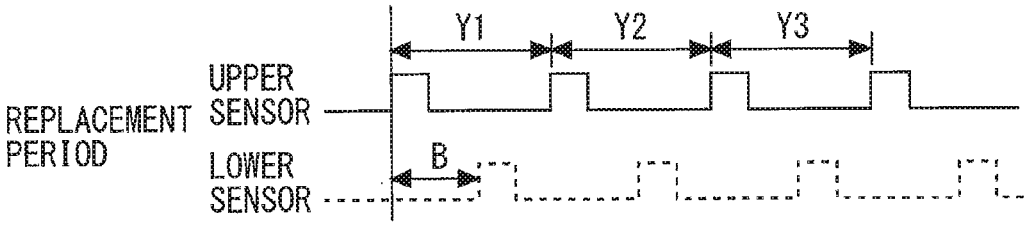
FIG. 3 is a graph illustrating a detection result from the upper sensor and a detection result from the lower sensor in the passenger-conveyor step-chain monitoring system according to Embodiment 1 of the present invention.

FIGS. 2 and 3 each illustrates the detection result from the upper sensor and the detection result from the lower sensor in the passenger-conveyor step-chain monitoring system according to Embodiment 1 of the present invention.

As illustrated in FIG. 2, when the passenger conveyor is operated to ascent immediately after installation of the passenger conveyor, the upper sensor 10 detects a waveform Xn corresponding to each of the plurality of steps 3. For example, the upper sensor 10 detects the waveform Xn depending on a step axis of each of the plurality of steps 3. For example, a waveform X1 is detected for the first step 3. A waveform X2 is detected for the second step 3. A waveform X3 is detected for the waveform that is three waveforms before the current waveform.

The monitoring unit 12*b* measures a time period A required for the lower sensor 11 to detect the step 3 by using the detection of the step 3 by the upper sensor 10 as a trigger.

As illustrated in FIG. 3, when the step chains 5 are elongated due to an aging deterioration caused by repeated loads and bending, the waveform corresponding to each of the plurality of steps 3 increases. Specifically, waveforms of Xn to Yn are obtained.

The monitoring unit 12*b* measures a time period B required for the lower sensor 11 to detect the step 3 by using the detection of the step 3 by the upper sensor 10 as a trigger.

In this case, the monitoring unit 12*b* determines that the time period corresponding to the length obtained by adding differences (Yn−Xn) between the upper sensor 10 and the lower sensor 11 at each of the plurality of steps 3 corresponds to the difference between the time period A and the time period B.

When the difference reaches a preliminarily set value, the determination unit 13*c* determines that the current time corresponds to the replacement period for replacing the step chains 5.

Next, an outline of an operation of the control device 12 will be described with reference to FIG. 4.

Figure 4:
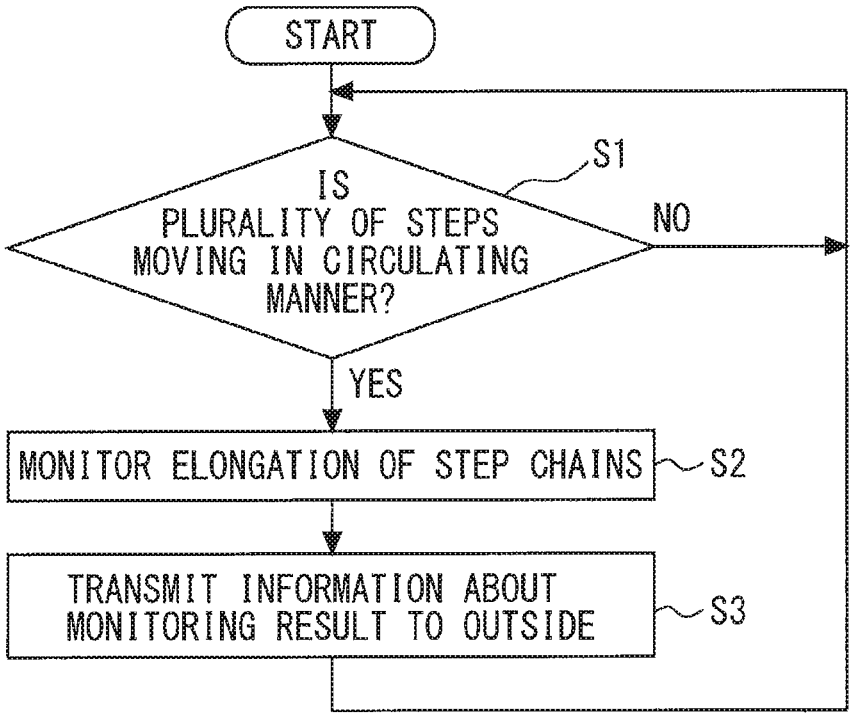
FIG. 4 is a flowchart illustrating an outline of an operation of a control device used in the passenger-conveyor step-chain monitoring system according to Embodiment 1 of the present invention.

FIG. 4 is a flowchart illustrating an outline of an operation of the control device used in the passenger-conveyor step-chain monitoring system according to Embodiment 1 of the present invention.

In step S1, the control device 12 determines whether the plurality of steps 3 is moving in a circulating manner. In step S1, if the plurality of steps 3 is not moving in a circulating manner, the control device 12 performs the operation of step S1. If the plurality of steps 3 is moving in a circulating manner in step S1, the control device performs the operation of step S2.

In step S2, the control device 12 monitors elongation of the step chains 5 based on the results of detecting the step 3 by the upper sensor 10 and the lower sensor 11. After that, the control device 12 performs the operation of step S3.

In step S3, the control device 12 transmits information about the monitoring result from the monitoring unit 12*b* to the external device. After that, the control device 12 performs the operation of step S1.

Next, an outline of the operation of the monitoring device 13 will be described with reference to FIG. 5.

Figure 5:
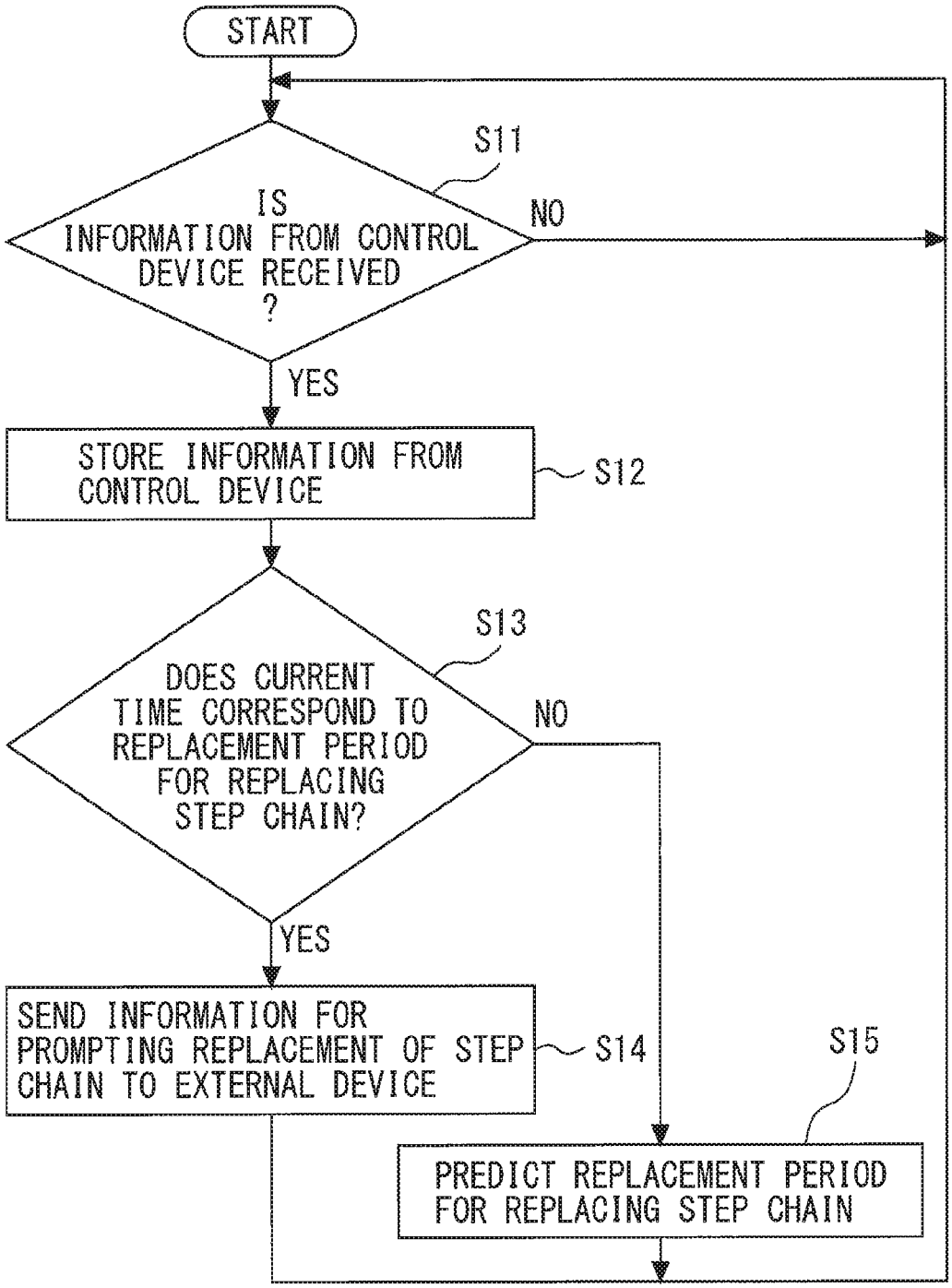
FIG. 5 is a flowchart illustrating an outline of an operation of a monitoring device used in the passenger-conveyor step-chain monitoring system according to Embodiment 1 of the present invention.

FIG. 5 is a flowchart illustrating an outline of an operation of the monitoring device used in the passenger-conveyor step-chain monitoring system according to Embodiment 1 of the present invention.

In step S11, the monitoring device 13 determines whether the information from the control device 12 is received. In step S11, if the information from the control device 12 is not received, the monitoring device 13 performs the operation of step S11. In step S11, if the information from the control device 12 is received, the monitoring device 13 performs the operation of step S12.

In step S12, the monitoring device 13 stores the information from the control device 12. After that, the monitoring device 13 performs the operation of step S13.

In step S13, the monitoring device 13 determines, based on the information from the control device 12, whether current time corresponds to the replacement period for replacing the step chains 5.

In step S13, if the current time corresponds to the replacement period for replacing the step chains 5, the monitoring device 13 performs the operation of step S14. In step S14, the monitoring device 13 sends, to the external device, information for prompting the replacement of the step chains 5. After that, the monitoring device 13 performs the operation of step S11.

In step S13, if the current time does not correspond to the replacement period for replacing the step chains 5, the monitoring device 13 performs the operation of step S15. In step S15, the monitoring device 13 predicts the replacement period for replacing the step chains 5 based on the history of the stored information. After that, the monitoring device 13 performs the operation of step S11.

According to Embodiment 1 described above, elongation of the step chains 5 is monitored based on the results of detecting the steps 3 by the upper sensor 10 and the lower sensor 11. Accordingly, it is possible to monitor elongation of the step chains 5 without adding a special device.

For example, in European regulations, the installation of a sensor for detecting the absence of the steps 3 is required. Therefore, elongation of the step chains 5 can be monitored using an inexpensive sensor which has a low accuracy and is capable of detecting only the absence of the steps 3.

Further, the information about the monitoring result from the control device 12 is transmitted to the external device. Accordingly, during maintenance work for the passenger conveyor, work for checking elongation of the step chains 5 can be eliminated.

Further, the monitoring device 13 predicts the replacement period for replacing the step chains 5 based on the information about the monitoring result from the control device 12. Accordingly, it is possible to automatically predict elongation of the step chains 5 at a high accuracy. As a result, the replacement of the step chains 5 that requires the passenger conveyor to stop for a long period of time can be planned in advance.

Note that the information stored in the monitoring device 13 may be compared with the content of a verification result from a maintenance company for the passenger conveyor. In this case, the information stored in the monitoring device 13 can be used for future improvement activities.

Further, on one side of the passenger conveyor, a pair of one-side sensors may be provided at upper and lower portions of the passenger conveyor. On the other side of the passenger conveyor, a pair of other-side sensors may be provided at upper and lower portions of the passenger conveyor. In this case, elongation of one of the pair of step chains 5 may be monitored based on the results of detecting the steps 3 by the pair of one-side sensors. Elongation of the other one of the pair of step chains 5 may be monitored based on the results of detecting the steps 3 by the pair of other-side sensors. In this case, a deviation between elongation of one of the pair of step chains 5 and the other one of the pair of step chains 5 can be automatically monitored.

Further, the arrangement of the monitoring unit 12*b*, the transmission unit 12*c*, the storage unit 13*b*, the determination unit 13*c*, and the prediction unit 13*d* is not limited. For example, the monitoring unit 12*b*, the transmission unit 12*c*, the storage unit 13*b*, the determination unit 13*c*, and the prediction unit 13*d* may be provided in the control device 12. Also, in this case, it is possible to monitor elongation of the step chains 5 without adding a special device.

Next, an example of the control device 12 will be described with reference to FIG. 6.

Figure 6:
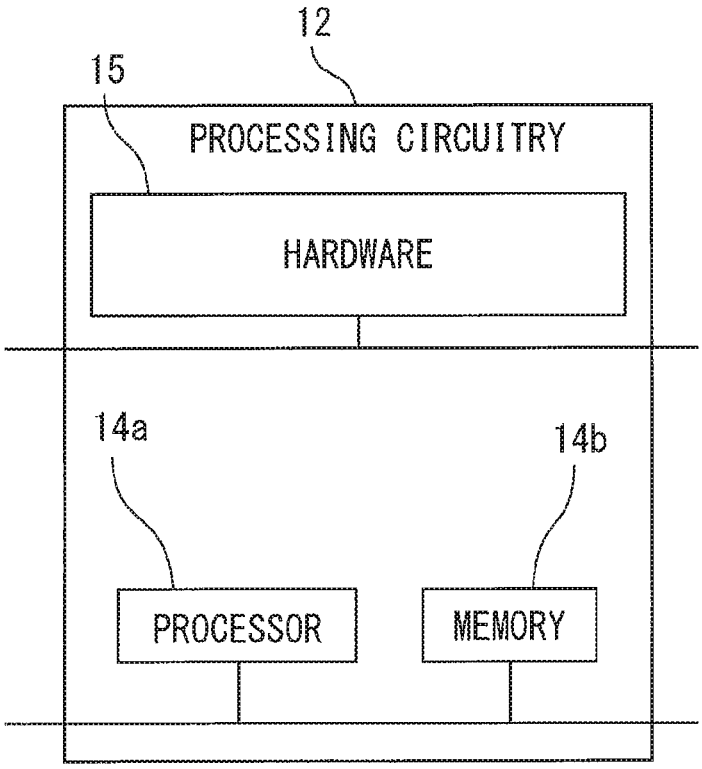
FIG. 6 is a hardware configuration diagram of the control device used in the passenger-conveyor step-chain monitoring system according to Embodiment 1 of the present invention.

FIG. 6 is a hardware configuration diagram of the control device used in the passenger-conveyor step-chain monitoring system according to Embodiment 1 of the present invention.

Each function of the control device 12 can be implemented by a processing circuitry. For example, the processing circuitry includes at least one processor 14*a* and at least one memory 14*b*. For example, the processing circuitry includes at least one piece of dedicated hardware 15.

If the processing circuitry includes at least one processor 14*a* and at least one memory 14*b*, each function of the control device 12 is implemented by software or firmware, or a combination of software and firmware. At least one of software and firmware is described as a program. At least one of software and firmware is stored in at least one memory 14*b*. At least one processor 14*a* reads out a program stored in at least one memory 14*b* and executes the program, thereby implementing each function of the control device 12. At least one processor 14*a* is also referred to as a central processing unit (CPU), a central processor, a processing device, an arithmetic device, a microprocessor, a microcomputer, or a DSP. For example, at least one memory 14*b* is a nonvolatile or volatile semiconductor memory, such as a RAM, a ROM, a flash memory, an EPROM, or an EEPROM, a magnetic disc, a flexible disc, an optical disc, a compact disc, a mini disk, a DVD, or the like.

If the processing circuitry includes at least one piece of dedicated hardware 15, the processing circuitry is implemented by, for example, a single circuit, a combined circuit, a programmed processor, a parallel programmed processor, an ASIC, or an FPGA, or a combination thereof. For example, each function of the control device 12 is implemented by a processing circuitry. For example, the functions of the control device 12 are collectively implemented by a processing circuitry.

A part of each function of the control device 12 may be implemented by the dedicated hardware 15, and the other part of each function of the control device 12 may be implemented by software or firmware. For example, the function of the control unit 12*a* may be implemented using a processing circuitry as the dedicated hardware 15, and functions other than the function of the control unit 12*a* may be implemented in such a manner that at least one processor 14*a* reads out a program stored in at least one memory 14*b* and executes the program.

In this manner, the processing circuitry implements each function of the control device 12 by using the hardware 15, software, or firmware, or a combination thereof.

Although not illustrated, the monitoring device 13 is also implemented by a processing circuitry equivalent to the processing circuitry of the control device 12.

INDUSTRIAL APPLICABILITY

As described above, a passenger-conveyor step-chain monitoring system according to the present invention can be used for a system that monitors elongation of a step chain without adding a special device.

REFERENCE SIGNS LIST

1 Lower platform
2 Upper platform
3 Step
4 Drive roller
5 Step chain
6 Skirt guard
7 Parapet
8 Guide rail
9 Moving hand rail
10 Upper sensor

11 Lower sensor
12 Control device
12*a* Control unit
12*b* Monitoring unit
12*c* Transmission unit
13 Monitoring device
13*a* Reception unit
13*b* Storage unit
13*c* Determination unit
13*d* Prediction unit
14*a* Processor
14*b* Memory
15 Hardware

The invention claimed is:

1. A passenger-conveyor step-chain monitoring system comprising:

processing circuitry configured to monitor elongation of a step chain attached to a step of a passenger conveyor based on a result of detecting the step by a sensor provided to detect an absence of the step, to store information about a monitoring result of elongation of the step chain every time monitor elongation of the step chain is monitored, and to predict a replacement period for replacing the step chain based on stored information about a plurality of monitoring results of elongation of the step chain, wherein the processing circuitry is further configured to monitor elongation of a step chain located on one side of the passenger conveyor based on a result of detecting a step by a pair of one-side sensors provided at upper and lower portions of the passenger conveyor on the one side of the passenger conveyor, and monitor elongation of a step chain located on another side of the passenger conveyor based on a result of detecting the step by a pair of other-side sensors provided at upper and lower portions of the passenger conveyor on the other side of the passenger conveyor.

2. The passenger-conveyor step-chain monitoring system according to claim 1, wherein the processing circuitry is further configured to transmit information about the monitoring result of elongation of the step chain.

* * * * *